US010989142B2

(12) United States Patent
Rabhi

(10) Patent No.: US 10,989,142 B2
(45) Date of Patent: Apr. 27, 2021

(54) REGENERATIVE COOLING SYSTEM

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 394 days.

(21) Appl. No.: 15/907,186

(22) Filed: Feb. 27, 2018

(65) Prior Publication Data

US 2018/0245538 A1 Aug. 30, 2018

Related U.S. Application Data

(60) Provisional application No. 62/463,912, filed on Feb. 27, 2017.

(51) Int. Cl.
*F02G 1/055* (2006.01)
*F02G 3/02* (2006.01)
*F02G 1/057* (2006.01)

(52) U.S. Cl.
CPC ..... *F02G 1/055* (2013.01); *F02G 1/057* (2013.01); *F02G 3/02* (2013.01); *F02G 2250/03* (2013.01); *F02G 2254/10* (2013.01); *F02G 2254/20* (2013.01)

(58) Field of Classification Search
CPC . F02G 1/055; F02G 1/057; F02G 3/02; F02G 2250/03; F02G 2254/10; F02G 2254/20; F02C 7/10
See application file for complete search history.

(56) References Cited

U.S. PATENT DOCUMENTS 2,298,625 A * 10/1942 Larrecq ..... 60/662
3,893,300 A * 7/1975 Connell ..... F02G 1/02 60/683
5,634,339 A * 6/1997 Lewis ..... F02C 6/18 60/650
5,857,436 A * 1/1999 Chen ..... F02B 33/22 123/68
2003/0228237 A1 12/2003 Holtzapple et al.
2014/0325981 A1* 11/2014 Rabhi ..... F02B 37/164 60/600
2016/0252048 A1* 9/2016 Rabhi ..... F02G 1/05 123/25 A

FOREIGN PATENT DOCUMENTS

FR 3041041 A1 3/2017

* cited by examiner

*Primary Examiner* — Jason H Duger
(74) *Attorney, Agent, or Firm* — Nixon & Vanderhye

(57) ABSTRACT

The regenerative cooling system (100) is provided for a regenerative heat engine (1) and comprises a cooling chamber (79) which surrounds a gas expander (78), leaving open a gas circulation space (80) between said chamber (79) and said expander (78), a working gas (81) expelled from the gas expander (78) circulating in said space (80) before returning to a regenerative heat exchanger (5) where it is cooled, a large portion of the heat of said gas (81) being reintroduced into the thermodynamic cycle of the regenerative heat engine (1).

7 Claims, 1 Drawing Sheet

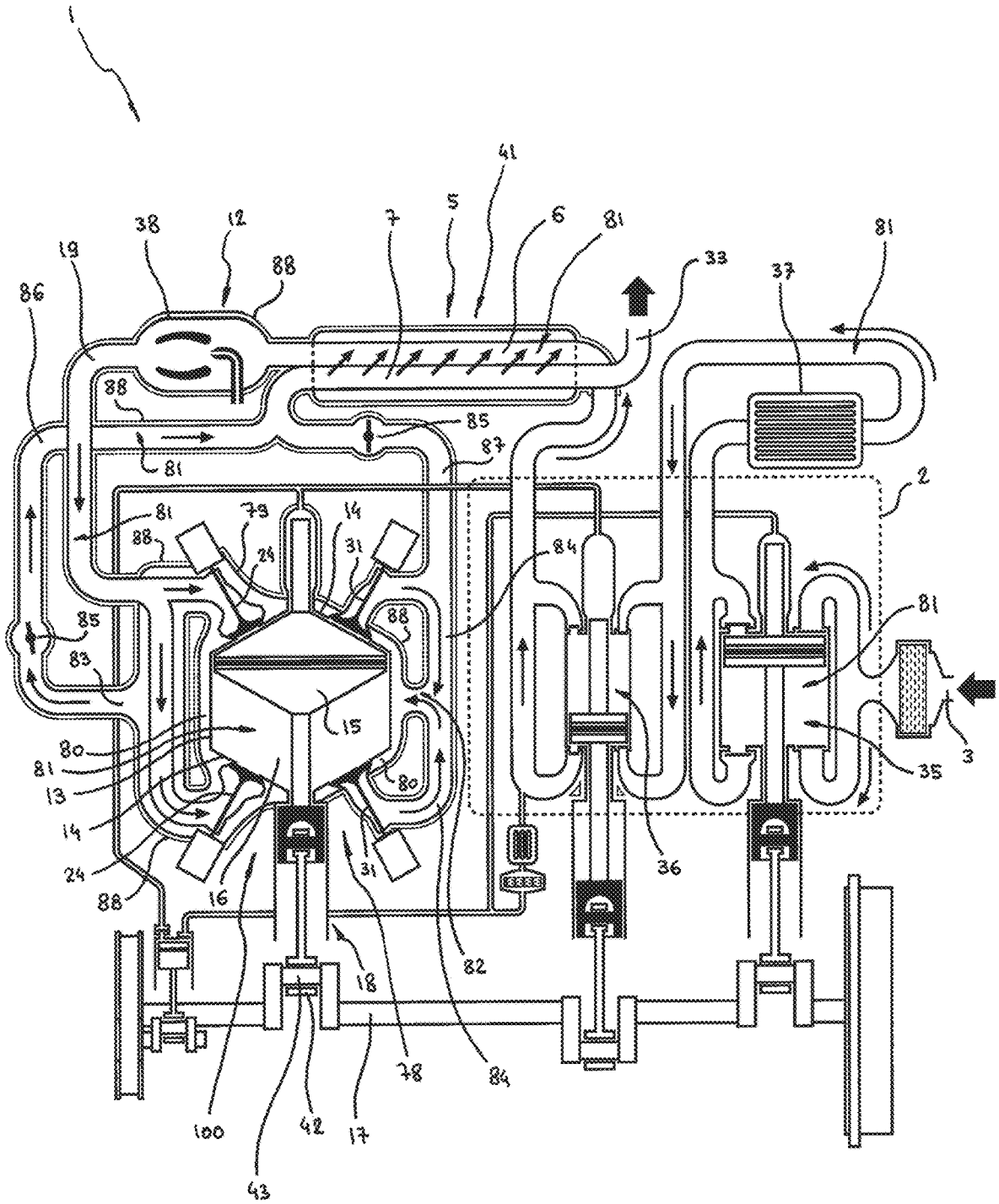
1
41
5
6
81
7
12
38
19
88
33
37
81
86
88
85
87
81
2
81
79
14
88
24
31
84
85
88
81
83
15
80
81
13
14
24
88
16
80
31
36
35
3
18
82
78
84
100
42
17
43

REGENERATIVE COOLING SYSTEM

BACKGROUND OF THE INVENTION

Field of the Invention

The present invention relates to a regenerative cooling system which constitutes, among other things, an improvement of the transfer-expansion and regeneration heat engine which was the subject matter of patent application No. FR 15 51593 of 25 Feb. 2015 belonging to the applicant, and the patent published on 1 Sep. 2016 as No. US 2016/0252048 A1, likewise belonging to the applicant.

Description of the Related Art

The Brayton regeneration cycle, ordinarily implemented by means of centrifugal compressors and turbines, is familiar.

According to this mode of embodiment, the cycle results in engines which provide a significantly higher efficiency that that of controlled-ignition engines. The efficiency is comparable to that of fast Diesel engines. However, it remains less than that of slow two-stroke Diesel engines with very large displacement, which are found for example in naval propulsion or the stationary production of electricity.

Besides a very modest overall efficiency, the engines with centrifugal compressors and turbines using the Brayton regeneration cycle deliver their best efficiency in a relatively narrow range of power and rotation speed. Moreover, their response time in power modulation is long. For these various reasons, their area of application is limited and they are hard to adapt to land transportation and especially to cars and trucks.

The transfer-expansion and regeneration heat engine of patent application No. FR 15 51593 had been proposed to remedy these drawbacks. That engine has the special feature of implementing the regenerated Brayton cycle no longer by means of centrifugal compressors and turbines, but rather by means of volumetric machines or at least by means of a volumetric expander formed around an "expander cylinder".

In the figures of patent application No. FR 15 51593 one notices that each end of said expander cylinder is closed by an expander cylinder head. Furthermore, said cylinder houses a dual-action expander piston to form two transfer-expansion chambers of variable volume. Said piston can be displaced in the expander cylinder to transmit work to a power takeoff shaft via a familiar connecting rod and a crank shaft.

Among the advantages claimed by the invention which is the subject matter of patent application No. FR 15 51593 is an efficiency of conversion of the heat into work which is much higher than that of alternative conventional internal combustion engines of whatever working principle, which means for the same work supplied a lower fuel consumption than that of said conventional engines and likewise lower emissions of associated carbon dioxide.

In order to achieve these goals, as clearly stated in patent application FR 15 51593, at least three conditions need to be met.

The first one is that the volumetric expander is effectively composed of a single cylinder, which is not the teaching of the prior art dealing with such machines. As an example, the patent US 2003/228237 A1 of 11 Dec. 2003 indeed comprises a compressor, a regenerative heat exchanger, a heat source and an expander, however the latter is not a cylinder, but instead what the inventors of that patent call a "gerotor".

The second condition is that the gas inlet and outlet in the expander cylinder are regulated by properly phased intake and exhaust metering valves, which results in the pressure vs. volume diagram shown by a figure in the patent application No. FR 15 51593.

The third condition is that the sealing device between the piston and the cylinder can operate at very high temperature.

It will be noted that the transfer-expansion and regeneration heat engine described in patent application No. FR 15 51593 meets this third condition by proposing an innovative air cushion segment formed by a continuous perforated inflatable and expansible ring lodged in an annular groove devised in the expander piston. Said ring defines with said groove a pressure distribution chamber connected to a pressurized fluid source.

This new sealing device with no direct contact to the expander cylinder makes possible the operation of the cylinder at high temperature, while the intake and exhaust metering valves in the cylinder heads which close off said cylinder make it possible to maximize the efficiency of the transfer-expansion and regeneration heat engine.

The innovative sealing device based on an air cushion segment was deliberately placed in patent application No. FR 15 51593 in a claim dependent on the main claim. As is easily understood, by presenting his invention in this way the inventor did not rule out other sealing solutions which may replace said segment, even through the latter is presented in said patent application as being a key element of the transfer-expansion and regeneration heat engine.

As is clearly stated in the patent application FR 15 51593, in order for the efficiency of the transfer-expansion and regeneration heat engine to be as high as possible, the internal walls of the expander cylinder need to be brought up to high temperature so that the hot gases introduced into said cylinder do not cool down upon contacting those walls, or at least are cooled down as little as possible by those walls. This holds at least for the internal walls of the expander cylinder proper, and for those of the cylinder heads cooperating with said cylinder.

According to the principle of engine thermodynamics put forth by Sadi Carnot, patent application FR 15 51593 proposes that the efficiency of the transfer-expansion and regeneration heat engine is greater as the temperature of the gases introduced into the expander cylinder is higher.

This is why patent application FR 15 51593 calls for the expander cylinder, the cylinder heads of the expander cylinder and the expander piston of the transfer-expansion and regeneration heat engine being made of materials resistant to very high temperatures such as ceramics based on alumina, zircon, or silicon carbide.

The hot portions and the components at high temperature of the transfer-expansion and regeneration heat engine have furthermore been the subject of patents for improvements of said engine. Accordingly, one may cite the patent application No. FR 15 58585 of 14 Sep. 2015 belonging to the applicant, which deals with a dual-action and adaptive-support expander cylinder, said cylinder being able to work at high temperature and to be subjected to thermal expansions different from those of the transmission case to which it is attached. In the same regard, one will note also the patent application No. FR 15 58593 of 14 Sep. 2015 likewise belonging to the applicant and dealing with a dual-action piston composed of a prestressed assembly and able to operate at temperature.

Let it be noted that the patent applications No. FR 15 58585 and No. FR 15 58593 just cited propose very robust solutions to handle the presence of parts at high temperature and parts at low temperature in the same apparatus.

In particular, the configurations proposed in said patents prevent in large measure the heat from migrating from the hot parts to the cold parts with which they are cooperating. This ensures an elevated efficiency of the transfer-expansion and regeneration heat engine.

On the other hand, the improvements proposed in the patent applications No. FR 15 58585 and No. FR 15 58593 do not alter the fact that if the temperature of the gases introduced into the expander cylinder of said engine is for example thirteen hundred degrees Celsius, the temperature of the internal walls of that cylinder will be locally close to thirteen hundred degrees Celsius, with an average temperature of those walls approaching for example one thousand degrees Celsius.

The temperature of these gases thus determines directly the temperature which must be withstood by the materials making up the hot parts of the expander cylinder of the transfer-expansion and regeneration heat engine. Hence, indirectly, the temperature resistance of these materials determines the maximum available efficiency of that engine.

It will be noted furthermore that the materials in question which can withstand very high temperatures are relatively few in number, inasmuch as they further need to provide an elevated mechanical strength at these same temperatures, while also being resistant to corrosion and oxidation.

Said materials are principally ceramics such as alumina, zircon, silicon carbide or silicon nitride. These materials are hard and difficult to machine. Consequently, the sale price of finished parts is relatively elevated, which is an impediment to the adoption by the automotive industry of the transfer-expansion and regeneration heat engine described in the patent application FR 15 51593. In fact, since that industry is oriented to the consumer market, it is highly sensitive to the manufacturing sale price, which needs to be as low as possible.

The ideal would thus be for the internal walls of the expander cylinder of this engine to be maintained at a maximum temperature of, for example, seven to nine hundred degrees Celsius. In fact, at such temperatures, more common materials which are less expensive to produce and machine than the ceramics, such as cast iron or stainless steel or refractories, can be used to manufacture the expander cylinder. The same holds for the cylinder heads and their respective plenums and ducts cooperating with that cylinder.

However, it is imperative on the one hand to prevent a lowering of the temperature of the hot gases admitted to the expander cylinder of the transfer-expansion and regeneration heat engine and on the other hand to allow the heat of those gases to escape as a pure loss through the colder walls of that cylinder with which those gases are brought into contact. In fact, these two actions would have the harmful consequence of significantly reducing the final efficiency of the transfer-expansion and regeneration heat engine.

In the current state of the art, therefore, one needs to choose between a transfer-expansion and regeneration heat engine with very high efficiency, yet costly and hard to produce, and an engine based on the same principle but resorting to materials less costly to produce, but at the price of a large decrease in efficiency. This constitutes a dilemma.

BRIEF SUMMARY OF THE INVENTION

In order to solve this dilemma, the regenerative cooling system of the invention in one particular embodiment allows:

- Significantly reducing the temperature of the internal walls of the expander cylinder and its cylinder heads of the transfer-expansion and regeneration heat engine which is the subject of the patent application FR 15 51593, making it possible to use materials of lower sale price to fabricate that cylinder and those cylinder heads without significantly reducing the total efficiency of said heat engine;
- Enabling a higher temperature of intake of gases into the expander cylinder than is possible for costly and complex materials such as ceramics—in the absence of the regenerative cooling system according to the invention;
- Providing the transfer-expansion and regeneration heat engine which is the subject of patent application FR 15 51593 with a higher final energy efficiency using materials of low sale price than is possible for the same engine with costly and complex materials such as ceramics.

It is understood that the regenerative cooling system according to the invention is addressed primarily to the transfer-expansion and regeneration heat engine which is the subject of the patent application FR 15 51593 belonging to the applicant.

However, this system may also be applied without restriction to the expander of any other engine with a Brayton regeneration cycle, whether said expander is of the centrifuge, the volumetric, or any other type, and provided that it cooperates with a regenerator of any given type.

The other characteristics of the present invention have been described in the description and in the secondary claims dependent directly or indirectly on the main claim.

The regenerative cooling system according to the present invention is designed for a regenerative heat engine, the latter comprising at least one regenerative heat exchanger having a high-pressure regeneration duct in which a working gas circulates to be preheated there, having been previously compressed by a compressor, while at the outlet of said duct the gas is superheated by a heat source before being introduced into a gas expander in which it is expanded to perform work on a power takeoff shaft, said gas being then expelled at the outlet of the gas expander and introduced into a low-pressure regeneration duct of the regenerative heat exchanger, said gas—by circulating in said duct—surrendering a large portion of its residual heat to the working gas circulating in the high-pressure regeneration duct, said system comprising:

- At least one cooling chamber which surrounds entirely or partly the gas expander and/or the heat source and/or a hot gas intake duct which connects said source to said expander, while leaving open a gas circulation space between said chamber on the one hand and/or said expander and/or said source and/or said duct on the other hand;
- At least one chamber inlet port which is directly or indirectly connected to the outlet of the gas expander and by which some or all of the working gas expelled from said expander via said outlet can enter into the gas circulation space;
- At least one chamber outlet port which is directly or indirectly connected to the low-pressure regeneration duct and by which the working gas can leave the gas circulation space before being introduced into said low-pressure duct.

The regenerative cooling system according to the present invention comprises a chamber inlet port which is connected to the outlet of the gas expander by a chamber inlet duct whose effective cross section is regulated by a flow control valve.

The regenerative cooling system according to the present invention comprises a chamber outlet port which is connected to the low-pressure regeneration duct by a chamber outlet duct whose effective cross section is regulated by a flow control valve.

The regenerative cooling system according to the present invention comprises an outlet of the gas expander which is connected to the low-pressure regeneration duct by a chamber bypass duct.

The regenerative cooling system according to the present invention comprises an effective cross section of the chamber bypass duct which is regulated by a flow control valve.

The regenerative cooling system according to the present invention comprises an exterior of the cooling chamber which is coated with a heat shield.

BRIEF DESCRIPTION OF THE DRAWINGS

The following description with respect to the enclosed drawing and given as a nonlimiting example will allow a better understanding of the invention, its characteristics, and the advantages which it may provide:

FIG. 1 is a schematic side view representation of the regenerative cooling system according to the invention such as may be implemented in the transfer-expansion and regeneration heat engine which is the subject of patent application No. FR 15 51593 belonging to the applicant, and according to one variant of said system whereby the outlet of the gas expander is connected to the low-pressure regeneration duct by a chamber bypass duct, such that the effective cross section of that bypass duct and of the chamber outlet duct is regulated by a flow control valve.

DESCRIPTION OF THE INVENTION

There is shown in FIG. 1 the regenerative cooling system 100, various details of its components, its variants, and its accessories.

As is shown in FIG. 1, the regenerative cooling system 100 is provided for a regenerative heat engine 1, the latter comprising at least one regenerative heat exchanger 5 having a high-pressure regeneration duct 6 in which a working gas 81 circulates, becoming heated there, and having been previously compressed by a compressor 2.

Upon leaving the high-pressure regeneration duct 6, said gas 81 is superheated by a heat source 12 before being introduced into a gas expander 78, in which it is expanded to produce work on a power takeoff shaft 17.

The working gas 81 is then expelled from the gas expander 78 and introduced into a low-pressure regeneration duct 7 of the regenerative heat exchanger 5, said gas 81—by circulating in said duct 7—surrendering a large measure of its residual heat to the working gas 81 circulating in the high-pressure regeneration duct 6.

In this context, it is clearly illustrated in FIG. 1 that the regenerative cooling system 100 according to the invention comprises at least one cooling chamber 79 which surrounds entirely or partly the gas expander 78 and/or the heat source 12 and/or a hot gas intake duct 19 which connects said source 12 to the expander 78, while leaving open a gas circulation space 80 between said chamber 79 on the one hand, and/or said expander 78 and/or said source 12 and/or said duct 19, on the other hand, the working gas 81 being able to circulate in this space 80.

It will be noted that the cooling chamber 79 can be made of drawn or hydro-formed stainless-steel plate, and it may be realized in several parts assembled to each other by welding, screwing, or riveting, after which the chamber may be attached directly or indirectly to the components 78, 12, 19 which it surrounds.

FIG. 1 shows that the regenerative cooling system 100 according to the invention further comprises at least one chamber inlet port 82 which is directly or indirectly connected to the gas expander outlet 78 and by which some or all of the working gas 81 expelled from said expander 78 via said outlet can enter the gas circulation space 80.

Again, in FIG. 1 it will be noticed that the regenerative cooling system 100 according to the invention also comprises at least one chamber outlet port 83 which is directly or indirectly connected to the low-pressure regeneration duct 7 and by which the working gas 81 may leave the gas circulation space 80 before being introduced into said low-pressure duct 7.

It will be noted that preferably the cooling chamber 79 surrounds the gas expander 78 and/or the heat source 12 and/or the hot gas admission duct 19 in tight fashion so that the working gas 81 can only enter into the gas circulation space 80 by the chamber inlet port 82, even though that gas 81 may only leave that space 80 by the chamber outlet port 83.

According to one variant embodiment of the regenerative cooling system 100 according to the invention as shown in FIG. 1, the chamber inlet port 82 may be connected to the outlet of the gas expander 78 by a chamber inlet duct 84 whose effective cross section is regulated by a flow control valve 85, this latter being able—depending on its position—to prevent, allow, or restrict the circulation of the working gas 81 in said duct 84.

As another variant, again shown in FIG. 1, the chamber outlet port 83 may be connected to the low-pressure regeneration duct 7 by a chamber outlet duct 86 whose effective cross section is regulated by a flow control valve 85, this latter being able—depending on its position—to prevent, allow, or restrict the circulation of the working gas 81 in said chamber outlet duct 86.

FIG. 1 also shows that another variant of the regenerative cooling system 100 according to the invention consists in that the outlet of the gas expander 78 may be connected to the low-pressure regeneration duct 7 by a chamber bypass duct 87 which allows the working gas 81 expelled from the outlet of the gas expander 78 to go directly from this outlet to the low-pressure regeneration duct 7 without moving through the gas circulation space 80.

According to this latter variant, the effective cross section of the chamber bypass duct 87 may optionally be regulated by a flow control valve 85, which latter may—depending on its position—prevent, allow, or restrict the circulation of the working gas 81 in said bypass duct 87.

In FIG. 1 it will be noted that, advantageously, the outside of the cooling chamber 79 may be coated with a heat shield 88 which may be formed of any heat insulating material known to the skilled person and which may coat—besides the cooling chamber 79—the various hot ducts and elements making up the regenerative heat engine 1.

It will be noted that, in this case, said heat shield 88 is provided in order to prevent any excessive heat loss which is unfavorable to the efficiency of the regenerative heat engine 1.

FUNCTIONING OF THE INVENTION

The functioning of the regenerative cooling system 100 according to the invention will be easily understood by considering FIG. 1.

In order to describe this functioning, we shall use here the sample embodiment of the regenerative cooling system 100 according to the invention when the regenerative engine 1 to which it is applied is made up of the transfer-expansion and regeneration heat engine which is the subject of patent application No. FR 15 51593 of 25 Feb. 2015, belonging to the applicant.

As can be seen in FIG. 1, the regenerative engine 1 here comprises a two-stage compressor 2 which is made up in particular of a low-pressure compressor 35 which takes in the working gas 81 from the atmosphere via a compressor inlet duct 3, the outlet of said low-pressure compressor 35 being connected to the inlet of a high-pressure compressor 36 via an intermediate compressor cooler 37.

FIG. 1 shows that, at the outlet of the high-pressure compressor 36, the working gas 81 is expelled into the high-pressure regeneration duct 6 which comprises the regenerative heat exchanger 5, in the present case being a countercurrent heat exchanger 41 which is familiar in itself. It shall be assumed here that the working gas 81 is expelled from the high-pressure compressor 36 at a pressure of twenty bars and at a temperature of two hundred degrees Celsius.

By circulating in the high-pressure regeneration duct 6, the working gas 81 is preheated to a temperature of six hundred fifty degrees Celsius by the hot working gas 81 which circulates in the adjacent low-pressure regeneration duct 7.

For simplicity, we shall consider that the efficiency of the regenerative heat exchanger 5 is one hundred percent. This means that the working gas 81 which circulates in the low-pressure regeneration duct 7 enters the latter at a temperature of six hundred fifty degrees Celsius and leaves that duct 7 at a temperature of two hundred degrees Celsius before being vented into the atmosphere via the engine outlet duct 33, while the working gas 81 which circulates in the high-pressure regeneration duct 6 enters the latter at a temperature of two hundred degrees Celsius and leaves at a temperature of six hundred fifty degrees Celsius.

Upon leaving the high-pressure regeneration duct 6, said working gas 81 is then superheated to fourteen hundred degrees Celsius by the heat source 12 which—according to this sample embodiment—is composed of a fuel burner 38.

Upon leaving said burner 38, the working gas 81 is routed by a hot gas intake duct 19 to the gas expander 78 which is in fact the expander cylinder 13 of the transfer-expansion and regeneration heat engine which is the subject of the patent application No. FR 15 51593.

It will be noted that the hot gas intake duct 19 is preferably made of ceramic with high temperature resistance as far as its connection to a head of the expander cylinder 14, capping one end or the other of the expander cylinder 13. Thus, the temperature of this duct 19 remains approximately equal to fourteen hundred degrees Celsius so that the working gas 81 circulating in said duct 19 maintains its temperature along its entire course.

Thus, as illustrated in FIG. 1, each end of the expander cylinder 13 is capped by an expander cylinder head 14 so as to define, with a dual-action expander piston 15, two transfer-expansion chambers 16. It will also be noted that each cylinder head has an intake metering valve 24 and an exhaust metering valve 31.

Thanks to the regenerative cooling system 100 according to the invention, the transfer-expansion and regeneration heat engine being hot, the expander cylinder 13 and the cylinder heads of the expander cylinder 14 are maintained at a temperature close to seven hundred degrees Celsius. This makes it possible to construct said cylinder 13 and said cylinder heads 14 of a less costly and more common material than ceramics, such as stainless steel or silicon ferritic cast iron.

As for the dual-action expander piston 15, and according to this nonlimiting example of the regenerative cooling system 100 of the invention, it is made of silicon nitride. The mean operating temperature of said piston 15 is on the order of eight hundred degrees Celsius.

It will be noticed in FIG. 1 that said piston 15 is connected by mechanical transmission means 19 to a power takeoff shaft 17, said means 19 being composed in particular of a connecting rod 42 articulating with a crank 43.

The working gas 81 brought up to a pressure of twenty bars and a temperature of fourteen hundred degrees Celsius is thus introduced into one or the other transfer-expansion chamber 16 by the corresponding intake metering valve 24.

Passing through the orifice held open by the intake metering valve 24, said gas 81 begins to cool slightly, especially upon contact with the internal walls of the head of the expander cylinder 14 which it passes through, and the internal walls of the transfer-expansion chamber 16 into which it is introduced for the purpose of being expanded there by the dual-action expander piston 15. Said walls—as we have seen above—are maintained at seven hundred degrees Celsius by the regenerative cooling system 100.

At this point, we shall assume that the working gas 81 loses on average one hundred degrees Celsius by washing the internal walls of the head of the expander cylinder 14, and the walls of the transfer-expansion chamber 16. Consequently, the temperature of the working gas 81 has dropped during its passage from the hot gas intake duct 19 to the transfer-expansion chamber 16, moving from fourteen hundred degrees Celsius to thirteen hundred degrees Celsius.

When the quantity of working gas 81 desired has been effectively introduced into the transfer-expansion chamber 16 by the corresponding intake metering valve 24, the latter closes, and the dual-action expander piston 15 expands said gas 81. In doing so, the piston 15 harvests the work produced by said gas 81, and communicates this work to the power takeoff shaft 17, particularly via the connecting rod 42 and the crank 43.

Once the working gas 81 has been expanded by the dual-action expander piston 15, the pressure of that gas 81 has dropped by around one bar absolute. The same is true of the temperature of this gas 81, which has changed from thirteen hundred degrees Celsius to five hundred fifty degrees Celsius.

The dual-action expander piston 15 having reached its Lower Dead Center, the exhaust metering valve 31 opens and said piston 15 expels said gas 81 into the chamber inlet duct 84 which routes said gas 81 to the chamber inlet port 82.

The working gas 81 then enters the gas circulation space 80 and is directed via this space to the chamber outlet port 83. In doing so, said gas 81 washes the hot external walls of the expander cylinder 13 and of the cylinder heads of the expander cylinder 14. Said external walls have been designed to be entirely or partly roughened and/or interspersed with geometrical patterns in order to produce a forced convection making the working gas 81 carry away more or less heat from said walls when said gas 81 circulates in contact with these walls.

Moreover, the internal geometry of the cooling chamber 79 and/or the external geometry of the expander cylinder 13 and/or the external geometry of the cylinder heads of the expander cylinder 14 may advantageously form channels which force all or some of the working gas 81 to follow a path or several simultaneous paths from the chamber inlet port 82 to the chamber outlet port 83 via the gas circulation space 80.

It will be understood that the double strategy of forced convection and forced path of the working gas 81 makes it possible to select, in the first place, the zones for export of heat from the hot external walls of the expander cylinder 13 and the cylinder heads of the expander cylinder 14 to said gas 81, in the second place the chronological order of said zones being swept by said gas 81, and thirdly and lastly the intensity of the forced convection along the path of said gas 81.

In any case, during its travel in the cooling chamber 79, the temperature of the working gas 81 withdraws heat from the hot external walls of the expander cylinder 13 and the cylinder heads of the expander cylinder 14 to the point where the temperature of that gas 81 changes progressively from five hundred fifty degrees Celsius to six hundred fifty degrees Celsius. In doing so and in connection with the strategy of forced convection and path chosen for the working gas 81, the gas homogenizes the temperature of the expander cylinder 13 and that of the cylinder heads of the expander cylinder 14, that temperature being maintained in the vicinity of seven hundred degrees Celsius.

The working gas 81 having reached its new temperature of six hundred fifty degrees Celsius, the gas 81 arrives at the chamber outlet port 83 and returns to the low-pressure regeneration duct 7 via the chamber outlet duct 86.

As will be understood from the preceding description, by circulating in the low-pressure regeneration duct 7 and before being vented into the atmosphere via the engine outlet duct 33, the working gas 81 expelled from the chamber outlet port 83 gives up a large measure of its heat to the working gas 81 circulating in the adjacent high-pressure regeneration duct 6.

Finally, and thanks to the regenerative cooling system 100 according to the invention, the heat extracted from the expander cylinder 13 and the cylinder heads of the expander cylinder 14 to maintain them at a temperature on the order of seven hundred degrees Celsius is in no way dissipated as a pure loss.

In fact, that heat is reintroduced into the thermodynamic cycle of the regenerative heat engine 1 to replace a portion of the heat needing to be provided by the fuel burner 38 in order to bring the working gas 81 up to a temperature of fourteen hundred degrees Celsius before the latter is sent to the expander cylinder 13 and then introduced into the transfer-expansion chambers 16.

One will notice in FIG. 1 the chamber bypass duct 87 which has a flow control valve 85. One will also notice in FIG. 1 that the chamber outlet duct 86 likewise has a flow control valve 85. These two valves 85 constitute a variant embodiment of the regenerative cooling system 100 according to the invention and are provided in order to regulate the temperature of the expander cylinder 13 and the cylinder heads of the expander cylinder 14.

In fact, if that temperature is too high, the flow control valve 85 of the chamber bypass duct 87 blocks said bypass duct 87, while the flow control valve 85 of the chamber outlet duct 86 opens that outlet duct 86. This has the effect of forcing the working gas 81 expelled from the transfer-expansion chambers 16 by their respective exhaust metering valve 31 to move through the gas circulation space 80 and return to the low-pressure regeneration duct 7.

On the other hand, if the temperature of the expander cylinder 13 and the cylinder heads of the expander cylinder 14 is too low, the flow control valve 85 of the chamber bypass duct 87 opens that bypass duct 87 while the flow control valve 85 of the chamber outlet duct 86 closes that outlet duct 86. This has the effect of preventing the working gas 81 expelled from the transfer-expansion chambers 16 by their respective exhaust metering valve 31 from moving through the gas circulation space 80 to return to the low-pressure regeneration duct 7. Thus, said gas 81 returns directly to said duct 7, via the chamber bypass duct 87.

It will be understood that, in practice, the flow control valves 85 are rarely either fully open or fully closed, and that said valves 85 can be kept slightly open to regulate the temperature of the expander cylinder 13 and the cylinder heads of the expander cylinder 14 without abrupt variation in flow rate of the working gas 81 circulating in the gas circulation space 80.

It will also be understood that the regulating of said temperature requires a control device composed, for example, of at least one temperature sensor and one micro-controller, which are known in themselves, and which make it possible to control the servo motors of whatever type so that each one actuates a flow control valve 85 to open or close.

According to a particular embodiment of the regenerative cooling system 100 according to the invention, the flow control valves 85 may also be joined together by a mechanical linkage to share the same servo motor. In this case, said linkage guarantees that when the first valve 85 is closed, the second one is open, and vice versa.

One will easily conclude from the previous description that the regenerative cooling system 100 according to the invention brings many advantages, especially when implementing the transfer-expansion and regeneration heat engine which is the subject of patent application No. FR 15 51593 belonging to the applicant.

As a first advantage, it is no longer necessary to make the expander cylinder 13 and the cylinder heads of the expander cylinder 14 from ceramic material, such as silicon carbide. In fact, this type of material is notoriously costly to produce on account of its great hardness, making it difficult to machine with conventional cutting or grinding tools Thanks to the regenerative cooling system 100 according to the invention, it is possible to replace such ceramic by cast iron or stainless steel. This greatly reduces the manufacturing sale price of the transfer-expansion and regeneration heat engine, which is decisive, especially for such an engine to be able to reach the automotive market.

As a second advantage, since the expander cylinder 13 and the cylinder heads of the expander cylinder 14 are colder, it is possible to use materials with very low thermal conductivity and great compressive strength, such as quartz, to make the hollowed pillars of the dual-action expander cylinder with adaptive support which is the subject of the patent application No. FR 15 58585 of 14 Sep. 2015 belonging to the applicant. In fact, while quartz is not compatible with a temperature of thirteen hundred degrees Celsius, it is perfectly compatible with a temperature of seven hundred degrees Celsius. Keep in mind here that the dual-action expander cylinder with adaptive support in question is one of the key improvements of the transfer-expansion and regeneration heat engine.

As a third advantage, since the cylinder heads of the expander cylinder 14 are maintained at seven hundred degrees Celsius, they may use preexisting valves of silicon nitride, which are compatible with these temperature levels.

Such valves have been developed, for example, by the NGK company and have been the subject of research for their low-cost industrialization, especially in the context of the project No. G3RD-CT-2000-00248 entitled "LIVALVES", funded in the framework of the fifth European FP5-GROWTH program.

As a fourth advantage, with a temperature of the interior wall of the expander cylinder 13 maintained in the vicinity of seven hundred degrees Celsius, the air cushion segment as proposed in the patent application No. FR 15 51593 belonging to the applicant can be made of a superalloy with durable resistance to these temperature levels, without risk of that segment being subjected to a temperature significantly higher than seven hundred degrees Celsius, especially when the transfer-expansion and regeneration heat engine is halted and before it has cooled down.

As a fifth advantage, applied to the transfer-expansion and regeneration heat engine which is the subject of patent application No. FR 15 51593, the regenerative cooling system 100 according to the invention makes it possible to limit the temperature exposure of the heat shields 88 surrounding the expander cylinder 13 and the cylinder heads of the expander cylinder 14. In fact, the cooling chamber 79 is intercalated between these shields 88 on the one hand, and said cylinder 13 and said cylinder heads on the other hand. The sale price and the durability of said shields 88 are thus improved to a major extent.

These advantages are obtained without detriment to the final energy efficiency of the transfer-expansion and regeneration heat engine.

On the contrary, the regenerative cooling system 100 according to the invention makes it possible to decouple the existing relation according to patent application No. FR 15 51593 between the temperature resistance of the materials making up the expander cylinder 13 and the cylinder heads of the expander cylinder 14 on the one hand and the temperature of the working gas 81 leaving the fuel burner 38 on the other hand.

To some extent, thanks to the regenerative cooling system 100 according to the invention, it is conceivable to raise the temperature of the working gas 81 leaving the fuel burner 38 in order to boost the final efficiency of the transfer-expansion and regeneration heat engine and this without compromising the temperature stability of the major elements making up that engine.

It will be noted that, besides the transfer-expansion and regeneration heat engine which is the subject of patent application No. FR 15 51593, the regenerative cooling system 100 according to the invention may be applied advantageously to any other regenerative heat engine 1 whose configuration and temperature characteristics are compatible with said system 100.

The possibilities of the regenerative cooling system 100 according to the invention thus are not limited to the applications just described and it should furthermore be understood that the preceding description was given solely as an example and it in no way limits the scope of said invention, which will not be evaded by replacing the details of execution as described by any other equivalent.

The invention claimed is:

1. A regenerative cooling system for a regenerative heat engine, the regenerative heat engine including a working gas, a gas expander, at least one regenerative heat exchanger, a heat source, and a hot gas intake duct connecting said heat source to said gas expander, the regenerative heat engine being configured such that the working gas circulates to be preheated in a high-pressure regeneration duct of the regenerative heat engine to be preheated after being compressed by a compressor, the working gas being superheated at an outlet of said high-pressure regeneration duct by the heat source, subsequently introduced into the gas expander such that the working gas is expanded to perform work on a power takeoff shaft, and subsequently expelled at an outlet of the gas expander and introduced into a low-pressure regeneration duct of the regenerative heat exchanger, the working gas circulating in said low-pressure regeneration duct such that the working gas surrenders a portion of residual heat from the working gas circulating in the low-pressure regeneration duct to the working gas circulating in the high-pressure regeneration duct, said regenerative cooling system comprising:

at least one cooling chamber at least partly surrounding the gas expander and the hot gas intake duct connecting said heat source to said gas expander, the at least one cooling chamber leaving open a gas circulation space between said cooling chamber, and said gas expander and said hot gas intake duct;

at least one chamber inlet port connected to the outlet of the gas expander and configured such that a portion of the working gas expelled from said gas expander via said outlet of the gas expander enters into the gas circulation space; and at least one chamber outlet port connected to the low-pressure regeneration duct and configured such that the portion of the working gas leaves the gas circulation space and is subsequently introduced into said low-pressure regeneration duct.

2. The regenerative cooling system as claimed in claim 1, wherein the chamber inlet port is connected to the outlet of the gas expander by a chamber inlet duct whose cross-section is regulated by a flow control valve.

3. The regenerative cooling system as claimed in claim 1, wherein the chamber outlet port is connected to the low-pressure regeneration duct by a chamber outlet duct whose cross-section is regulated by a flow control valve.

4. The regenerative cooling system as claimed in claim 1, wherein the outlet of the gas expander is connected to the low-pressure regeneration duct by a chamber bypass duct.

5. The regenerative cooling system as claimed in claim 4, wherein a cross-section of the chamber bypass duct is regulated by a flow control valve.

6. The regenerative cooling system as claimed in claim 1, wherein an exterior of the cooling chamber is coated with a heat shield.

7. The regenerative cooling system as claimed in claim 1, wherein the at least one cooling chamber entirely surrounds the gas expander.

* * * * *